United States Patent [19]

Grinwald

[11] 4,253,171

[45] Feb. 24, 1981

[54] ELECTROMECHANICAL CHARACTER DISPLAY

[75] Inventor: Harold M. Grinwald, Big Bend, Wis.

[73] Assignee: Everbrite Electric Signs, Inc., South Milwaukee, Wis.

[21] Appl. No.: 58,060

[22] Filed: Jul. 16, 1979

[51] Int. Cl.[3] ..... G04B 19/30

[52] U.S. Cl. ..... 368/67; 368/77; 368/227; 368/233; 340/380; 340/757

[58] Field of Search ..... 58/23 R, 50 R, 50 A; 340/380, 806, 809, 810, 757; 368/67, 77, 82, 223, 233, 227, 239

[56] References Cited

U.S. PATENT DOCUMENTS

| | | | |
|---|---|---|---|
| 2,579,166 | 12/1951 | Youhouse | 58/125 B |
| 3,566,602 | 3/1971 | Bergey et al. | 58/50 R |
| 3,673,787 | 7/1972 | Kovacevic | 58/50 R |
| 3,889,196 | 6/1975 | Gibson et al. | 340/380 |
| 3,918,052 | 11/1975 | Bricher | 340/757 X |

*Primary Examiner*—Edith S. Jackmon

*Attorney, Agent, or Firm*—Ralph G. Hohenfeldt

[57] ABSTRACT

The segments of several 7-segment character displays are defined by elongated light distributors in the form of slots or a series of holes which are in a panel. A large area light source is located on the rear side of the panel. Rotatable opaque disks are interposed between the light source and characters. Each disk has an array of holes for transmitting light to predetermined ones of light pipes which lead to slot segments in one embodiment and which lead to the holes that define segments in another embodiment. When a disk is rotated, different groups of holes in the disks become aligned consecutively with the light pipes where they are used or with the panel holes to thereby illuminate selected character segments so they define a sequence of characters such as the numbers zero to nine. In a digital clock application, a synchronous motor drives a first disk in angular steps to define minutes at their rate of occurrence. The first disk drives a second disk and the second disk drives a third for defining tens of minutes and hours, respectively.

10 Claims, 13 Drawing Figures

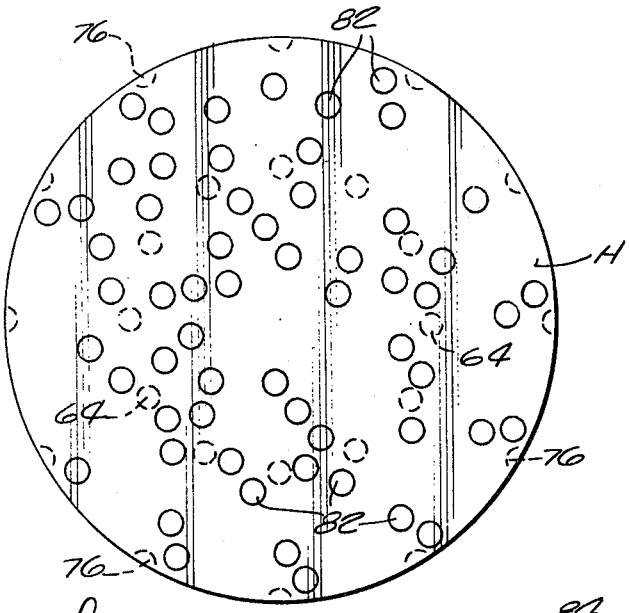
Fig. 9
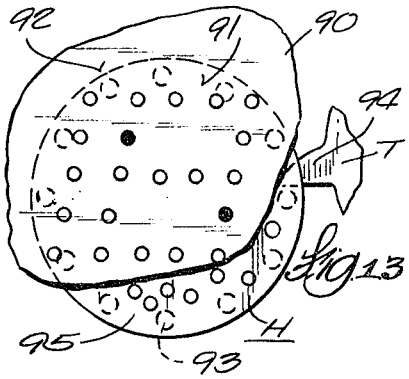
Fig. 13
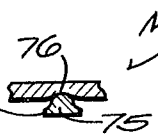
Fig. 5
Fig. 10
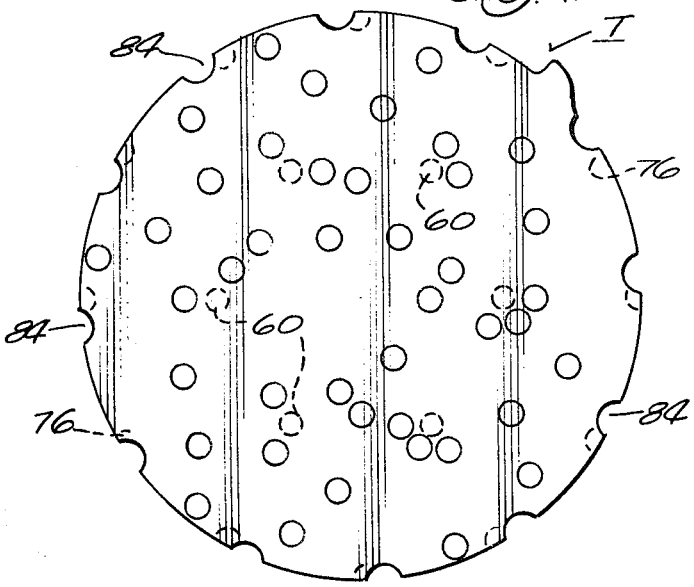
Fig. 11
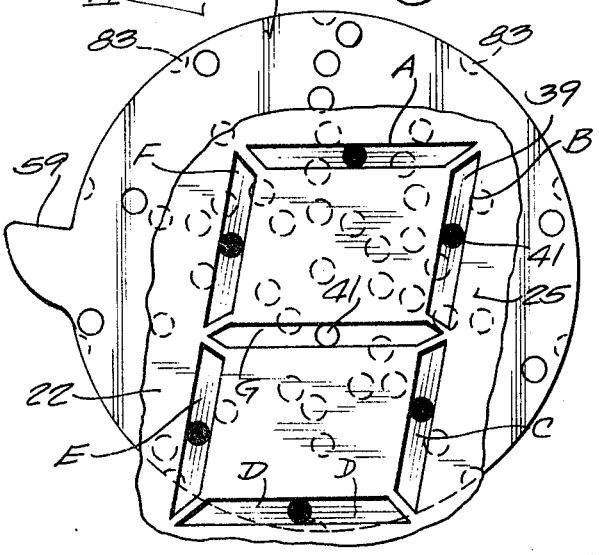
Fig. 12
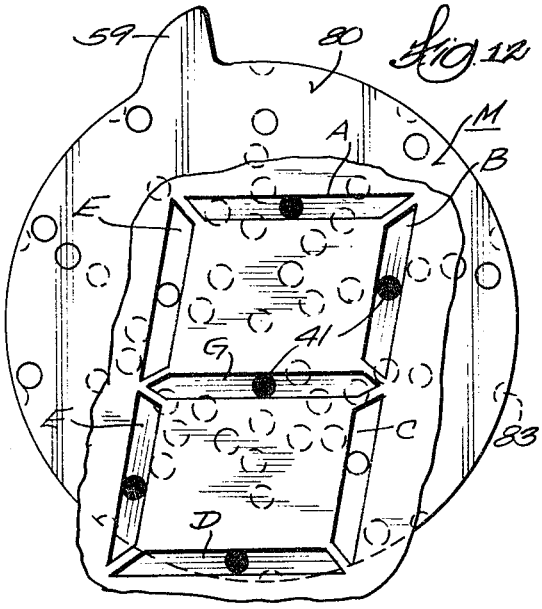

ELECTROMECHANICAL CHARACTER DISPLAY

This invention relates generally to segmented character displays. The invention will be exemplified herein in an electromechanical digital clock which uses 7-segment digital displays.

In electromechanical digital clocks a one revolution per minute electric motor is customarily used for controlling illumination of the segments in 7-segment digital or character displays in a fashion that results in the time of the day being displayed. Generally, these clocks use pairs of relatively movable plates or disks for each digit, or at most two digits, to bring about the effect of illuminating selected segments which define the digits that are to be read. There is a light source behind the plates or disks. The pairs of plates or disks or both have arrays of holes or elongated slots and are driven cyclically relative to each other to register holes so they can pass light and define or illuminate the segment in each character which should be illuminated to produce the numbers composing the time of the day.

Major disadvantages of electromechanical clocks of this and other known types are that they have too many plates or disks that must be shifted or rotated in proper synchronism to develop the characters and usually they have many other moving parts such as slides, guides, cams, links and gear trains too. This complexity results in higher than desired product cost and in lower than desired reliability.

SUMMARY OF THE INVENTION

The electromechanical digital clock described herein is distinguished by its simplicity and use of a minimum number of moving parts. The preferred embodiment comprises a stationary opaque plate in which the seven segments that comprise each digit or character are defined by slots. There is a light distributor coextensive with each slot. A light pipe leads into each distributor from its rear. Light which enters through each pipe is spread out or distributed uniformly over the length of the slot. A light source is arranged to project light toward the back of the digits and into the light pipes. A rotatable opaque disk or mask is interposed between the light source and each character or digit. Each disk has a plurality of holes or light transmissive openings. When the disk is rotated in predetermined equal angular steps or increments, the holes reach positions where certain ones of then will couple light from the source to certain light pipes to thereby illuminate segments which are visualized as the outline of the character or digit that is to be displayed. The holes in the disks are so arranged that a complete revolution of a disk will cause the numbers 0–9 to be displayed in sequence. The slots could define alphabetical characters as well as numerical characters.

In a digital clock useage of the character display a one revolution per minute motor turns a pawl which steps the minutes display disk in equal angular increments. A pawl or lug on this disk drives the adjacent tens of minute disk directly and this disk drives an adjacent hours disk so that all disks maintain their synchronism and cause the time to be displayed with accuracy within a minute.

General objects of the invention are to provide a digital character display, such as a clock, which has a minimum number of movable parts, is easy to assemble and provides uniformly and brightly illuminated character displays which makes it easy to read.

How the clock design outlined above is implemented and how the foregoing and other objects of the invention are achieved will be evident in the ensuing more detailed description of a preferred embodiment of the invention which will now be described in reference to the drawings.

DESCRIPTION OF THE DRAWING

FIG. 5 is a section of a detent taken on the line 5—5 in FIG. 3;

FIG. 9 is a plan view of a perforated opaque plate formed as a disk which is used in conjunction with the hours digit display in the clock;

FIG. 10 is a plan view of the disk plate that is used in conjunction with tens of minutes digit display in the clock;

FIG. 11 is a plan view of the disk plate that is used in conjunction with the minutes digit display, said disk being registered with a digit in such relation for its segments to define the numeral 0 (zero);

FIG. 12 shows the minutes disk plate of FIG. 11 rotated through two angular steps for producing the numeral 2 (two); and FIG. 13 shows an alternative 7-segment character display where the light distributors defining segments comprise a series of holes in a panel and there is a perforated rotatable disk behind the panel.

DESCRIPTION OF A PREFERRED EMBODIMENT

Figures 1, 6, 7, 8:
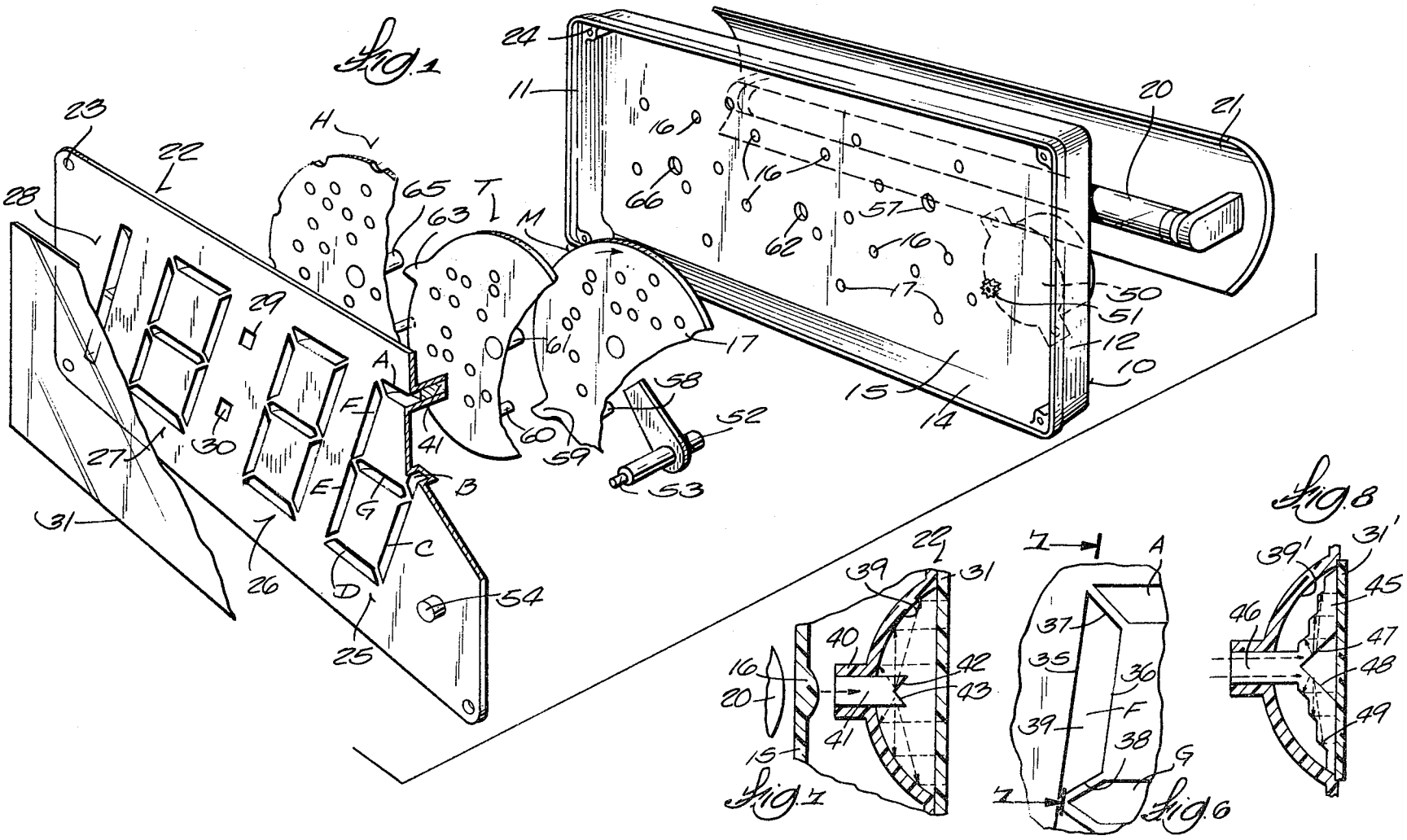
FIG. 1 is an exploded perspective view of a clock designed in accordance with the invention.
FIG. 6 is a front view of one full segment and fragments of other segments of a 7-segment digit made in accordance with the invention.
FIG. 7 is a section of a segment and its light distributor as viewed in the direction of the arrows 7—7 in FIG. 6.
FIG. 8 is an alternative embodiment of a segment and its light distributor.

The clock in FIG. 1 comprises a case which is generally designed by the reference numeral 10 and is preferably molded from plastic material. The case has sidewalls 11 and 12, top and bottom walls 13 and 14 and a rear wall 15. Several light condensing lenses such as those marked 16 and 17 are formed in rear wall 15. The lenses could be molded or inserted in a separate plate, not shown, which might be fastened over a suitable opening in rear wall 15 of case 10. In this design, there is a lens for each segment in each digit or character which is to be displayed for reasons which will be apparent later.

A large area light source such as fluorescent tube 20 is located behind rear wall 15 of case 10 for radiating light to the lenses. Light source 20 is adjacent a reflector 21.

A character or digit display panel 22 is shaped for fitting into the front opening of case 10. Panel 22 has holes such as the one marked 23 in its corners through which screws may be inserted for threadingly engaging in holes 24 in the corners of the casing.

Panel 22 is generally opaque and, in this clock design, is provided with four 7-segment digital displays which are indicated generally by the reference numerals 25–28. Digit 25 is for representing minutes of time. Digit 26 represents tens of minutes. Digits 27 and 28 cooperate to represent the hours. Panel 22 is also provided with a pair of zones or dots 29 and 30 which preferably have a unique color, are light transmissive and cooperate to provide a colon between the hours and minutes digits. For the purposes of discussion, a typical digit 25 has its segments identified with the letters A–G in accordance with convention. How panel 22 and its associated digits are constructed will be described in detail momentarily.

The clock in FIG. 1 is also provided with a diffuser panel 31 such as is customarily used in 7-segment digital displays to minimize the effects of ambient light and to produce a more contrasting and pleasing appearance between the illuminated segments and their surroundings. Diffuser panel 31 provides a frosted effect and may contain a translucent coloring material as is commonplace.

Refer now to FIGS. 6 and 7 for a description of how the segments which compose a character such as a digit are constructed. In FIG. 6, typical segment F comprises a channel which has straight sides 35 and 36, beveled ends 37 and 38 and a concave bottom 39 which can be seen in profile in FIG. 7. Bottom surface 39 constitutes a light distributor and is preferably coated with a diffusely reflective material such as white paint although it could be a bright specular surface as well. The wall which provides bottom surface 39 has a tubular extension 40 on it which is occupied by a light conducting conduit such as light pipe 41. The light pipe may be methyl methylcrylate or similar clear plastic but it may be colored if desired. As shown in FIG. 7, one of the condensing lenses such as the one marked 16 in the rear wall of case 10 is aligned with every light pipe of every segment so as to project light axially of pipe 41. Light pipe 41 is notched at the end of it which is in the concave channel to produce mutually angulated surfaces 42 and 43 which function as refracting surfaces in an optical prism. Thus, these surfaces 42 and 43 bend the bundle of light rays conducted axially by the light pipe in lateral directions to effectuate distribution of the light over the entire concave reflecting surface 39. This light is, of course, then directed toward the open side of the concave channel. As may be seen in FIG. 7, the diffuser plate 31 overlays all of the light distribution channels that comprise the segments of all of the digits.

The concave and preferably parabolic light distributor channels are advantageously molded integrally with the remainder of digit panel 22 so that the distributor channels and panel are constituted by one molded plastic piece. The light pipes such as 41 may be inserted with adhesive into tubular extensions 40 after panel 22 is molded. In FIG. 1, one of the light pipes 41 is shown in relation to the channel which defines segment A of digit 25. The refracting surfaces 42 and 43 are preferably at the focus of the parabola if the curved reflecting surface is parabolic. Of course, all of the digit segments are made in the same way.

FIG. 8 shows an alternative type of light distributor for a character segment. This form of distributor relies mainly on refraction for uniformly distributing light over the lengths of the segments. It has a concavity 39' which does not necessarily have to be reflective. The concavity has a length corresponding with the desired length of a segment. A prism element 45 having a rearwardly extending light pipe portion 46 is located in the segment channel. The prism is notched in its center region to provide two refractive surfaces 47 and 48 which diffract or reflect light from its axial path in light pipe 46 in lateral directions where the rays of light further encounter prism reflecting surfaces such as the one marked 49. The prisms direct the light uniformly toward diffuser panel 31'. The front face of prism distributor 45 could, for instance, have a sawtooth-shaped cross section, not shown, to provide the properties of a Fresnel lens.

Figure 2:
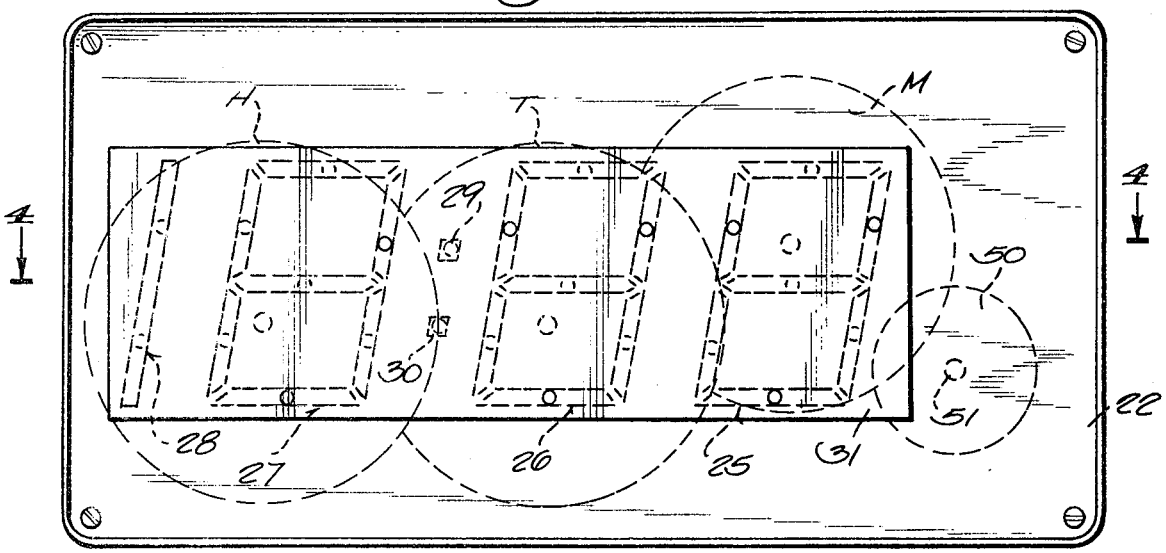
FIG. 2 is a front view of the assembled clock.

Refer now to FIG. 2 which shows a front view of the assembled clock. The diffuser panel 31 overlays the digits or numerical characters which are shown in dashed lines. The ends of the light pipes appear as small circles and one of the light pipes is marked 41. The outlines of the perforated circular plate or minute disk M, tens of minutes disk T, and hours disk H, can also be seen in this view behind the digits. These plates or disks do not necessarily have to be circular. The term disk is used herein as a generic term for any suitable plate means. The outline of the drive motor 50 and its drive pinion 51 are also visible in FIG. 2. The disks are similarly identified in FIGS. 1 and other figures by the letters M, T and H.

Figure 3:
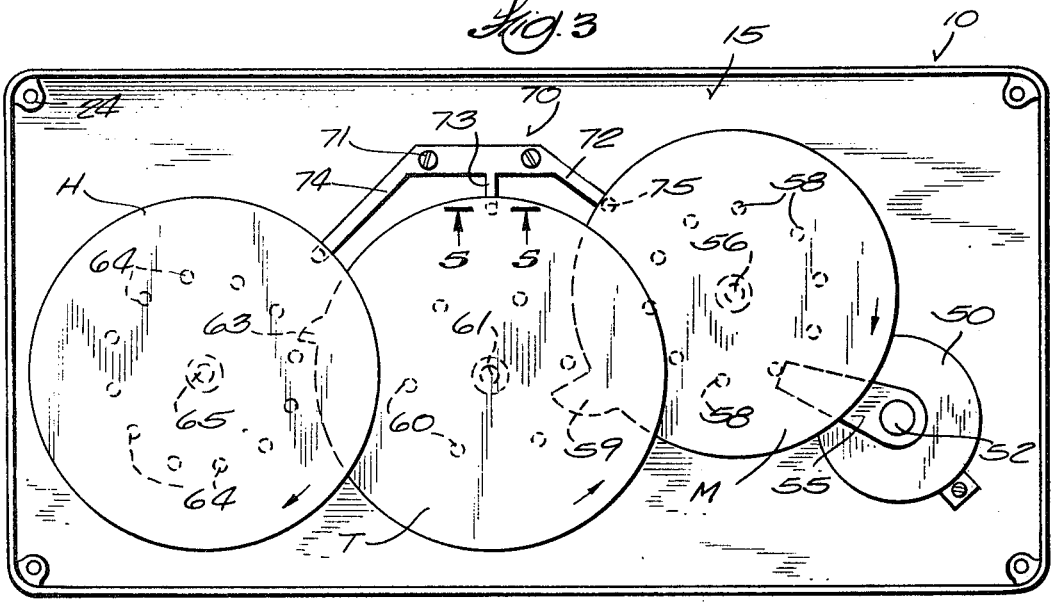
FIG. 3 is a view of the clock with its front diffuser panel and digit panel removed to illustrate how the disks which sequence the segments in a character are arranged.

FIG. 3 shows the clock before digit panel 22 is installed. The disks M, T and H are drawn with the plurality of light transmissive holes which they actually contain being omitted from this view to avoid obscuring the mechanical parts which are to be described. The cylindrical body of the one revolution per minute clock drive synchronous motor 50 is apparent in FIG. 3. By referring to FIG. 1, one may see that motor 50 is fastened to the rear wall 15 of case 10 and that a pinion 51 on the motor shaft extends into the case. Pinion 51 is engaged in a complementarily shaped socket in the end of a shaft 52 whose one end 53 is journaled in a bushing 54 which is set on the rear face of digit panel 22. As can be seen in FIGS. 1 and 3, shaft 52 has a drive arm or pawl 55 extending radially from it.

Figure 4:
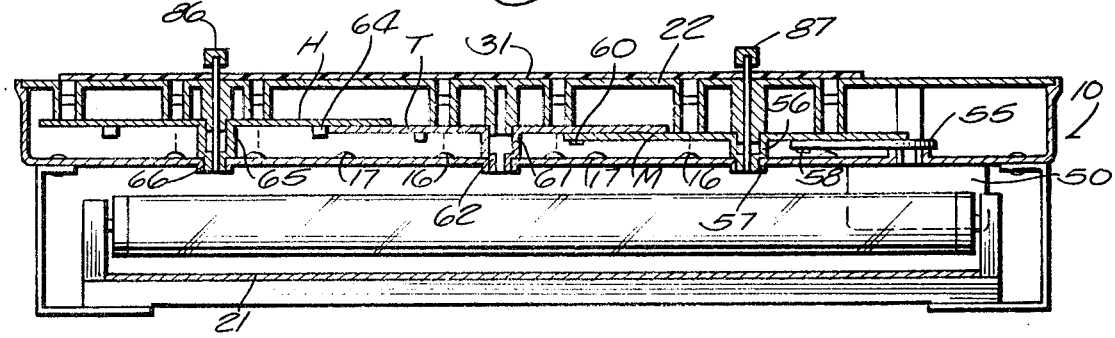
FIG. 4 is a transverse section taken generally along the line 4—4 in FIG. 2.

Minute disk M has a tubular shaft 56 which is journaled in a bearing socket 57 as can be seen in FIG. 1 and the FIG. 4 cross sectional view. Several pins 58, arranged in a circular, extend rearwardly from disk M. As shown, there are ten equiangularly spaced pins 58 that enable the disk to be indexed in angular steps to produce the digits 0–9 as will be explained. Disk M is turned or indexed rotationally as a result of motor pawl 55 striking one of the pins and then clearing it for each revolution of the motor shaft, that is, once per minute. Disk M has an integral drive lug or pawl 59 for driving adjacent tens of minutes disk T rotationally.

Disk T has six pins 60 extending rearwardly. They are arranged in a circle and are in the path of lug 59 on disk M. Disk T has a shaft 61 which, as can be seen in FIGS. 4 and 1, is journaled in a bearing socket 62 in rear wall 15 of case 10. It will be evident that for every one revolution of minute disk M, tens of minutes disk T will be advanced one-sixth of a revolution to represent a time lapse of ten minutes.

Disk T is provided with a lug 63 which is in driving engagement with a circular array of twelve pins 64 which extend rearwardly from the next disk which is the hours disk H. Disk H has a shaft 65 which is journaled in a bearing socket 66 as can be seen in FIGS. 1 and 4. By virtue of pawl 63 on disk T driving disk H by means of pins 64, disk H wlll turn one-twelfth of a revolution for every full revolution of disk T.

In the illustrative embodiment the drive pins 58, 60 and 64 which extend rearwardly from the three disks M, T and H, respectively, are equiangularly spaced and the disks are stepped equiangularly. It is, of course, not necessary for the disks to be stepped equiangularly as long as a disk returns to the same angular position in each revolution. On some occasions it may be necessary to arrange the light transmitting openings in a disk or disks in a way that requires successive inequal steps to avoid having openings transmitting light incorrectly at certain angular positions.

As shown in FIG. 3, a detent 70 is mounted to the rear wall 15 of case 10 with screws 71. This detent may be made of spring metal or plastic and has three spring prongs 72, 73 and 74. The detent is for assuring that the disks M, T and H will stay in definite angular positions to which they are stepped. A typical spring prong 72 terminates in a dimple 75 which can be seen in FIG. 5. As can also be seen in that figure, disk M has a series of indentations 76 near its peripheral margin into which dimples 75 are spring-biased for the purpose of holding disk M in a definite position. All disks have a series of indentations corresponding in number to the number of angular positions through which they are stepped to make a full revolution. Thus, disk M has ten equiangular indentations, disk T has six and disk H has twelve indentations. Detent prong 73 works on disk T and prong 74 works on disk H.

The manner in which the segments of the various digits are illuminated to produce a sequence of numbers for telling time will now be described. The operational mode is easiest to illustrate with the use of FIGS. 11 and 12. FIG. 11 shows how opaque disk M is provided with a multiplicity of holes which are arranged over its area in a predetermined pattern and which holes are collectively designated by the reference numeral 80. The segments A–G of the minutes indicating digit 25 are shown in digit panel 22. A typical concave channel and its reflective surface 39, constituting a light distributor previously discussed in connection with FIG. 7, is given the same reference numeral as in that figure. Typical light pipes feeding the segments appear as circles which are similarly marked 41.

In FIG. 11, minutes disk M has been rotated to an appropriate angular position for causing the segments to be illuminated which results in the numeral 0 being displayed. This means that segments A, B, C, D, E and F are illuminated but cross segment G is not. Illumination of the segments just mentioned results from the fact that a certain group of holes which make up the entire group 80 in disk M have become aligned with the light pipes 41 simultaneously while holes, exclusive of these members of the group are not aligned and have no effect on the display.

In FIG. 12, disk M has been rotated through two angular steps of 36° each or a total of 72° from the FIG. 11 position. This aligns a different set of holes in the group 80 with light pipes 41 in segments A, B, G, E and D which, as a result of these segments being illuminated, causes the numeral 2 to be displayed. The jump from displaying 0 in FIG. 11 to displaying 2 in FIG. 12 was made with the omission of count 1 for illustrative purposes only. It will be understood that as disk M is rotated in 30° steps from its FIG. 11 rotational position, segments will become illuminated in such order as to result in displaying the sequence of numerals from 0 to 9 and then 0 and the ensuing sequence will repeat.

The other disks operate in a similar fashion. FIG. 10, for instance, shows tens of minutes disk T which is driven rotationally as a result of pawl 59 engaging successively with its circular array of drive pins 60. Disk T also has an array of holes such as those marked 81. Particular sets of these holes become aligned with light pipes in the segments which compose the tens of minutes digit 26 to cause appropriate segments and digits to be illuminated in a sequence of six steps which results in numerals 0–5 being produced by digital display 26.

In FIG. 9, the hours disk H is shown. It couples light beams to both digits 27 and 28, shown in FIGS. 1 and 2, to produce a sequence of numbers from 1 to 12. Disk H has an array of holes 82 which, as in the previous examples, include sets which become aligned simultaneously with light pipes to produce the particular illuminated digits in sequence. The 12 drive pins 64 on the back of disk M are shown in FIG. 9 to be spaced by 30° angles to account for the 12 steps through which disk H is rotated to make a complete revolution.

Observe in FIGS. 1–4 that disk M overlaps disk T and that disk T overlaps disk H. This could result, for example, in an opaque portion of disk M shadowing one of the holes in disk T that should not be occluded if light is to be coupled to a light pipe in a segment which must be illuminated for producing a particular digit. To avoid undesired occlusion, disk M, as seen in FIG. 11, has a series of peripheral notches 83 in appropriate places which have been determined to be required in order to avoid occlusion. Disk T in FIG. 10 also has some notches 84 in its periphery for the same purpose. Disk M in FIG. 9 does not require such notches since it is located where it will not occlude the holes in any other disk as is evident from inspection of FIG. 1. Colon dots 29 and 30 are always illuminated.

The locations of the multiplicity of holes in each of the disks is most easily determined experimentally. A first step in designing a clock or other digital display in accordance with the invention might be to lay out the digits which are to be displayed on a sheet in whatever arrangement is desired. A circle, representative of a disk, may then be drawn on a transparent sheet and the circle may be divided into the number of equal angles which correspond with the number of rotational steps which are required to define a sequence of numerical digits or alphabetical characters. A point within the confines of the character is then established as the rotational point for the circle on the transparent disk. The sheet and transparent disk should have index marks which when in registry, establish the zero angle point. Circles, which will later correspond with the multiplicity of holes, are then drawn in coincidence with the pair of light pipes which are present in segments B and C which, when illuminated, form the 1 digit. The transparent disk is then rotated one angular step and circles are drawn in coincidence with the light pipes or circles corresponding to them or the segments A, B, G, E and D which produce the numeral 2. Incrementing by an angle and drawing the circles for the holes is repeated until the holes for producing all of the numerals in sequence by rotating the disk in a single direction are obtained. It may turn out that some disk holes which are necessarily for illuminating the segments required for defining a particular digit also provide an opening such that a segment which should not be illuminated is illuminated. This situation can be overcome by shifting the rotational point of the disk to another position within the character and going through the procedure again.

When a clock is being designed, the procedure must be carried out again for the tens of minutes disk T and the hours disk H. Eventually, three disks will be produced which have circles at the places where there should be holes for coupling light to the light pipes in the appropriate segments of each digit or character. It might also be necessary to insert holes or notches in one or more of the disks to avoid having an opaque portion of one disk occluding the holes in another which should be open for producing particular characters.

Note in FIG. 4 that the H and M disks have central pins terminating in knobs 86 and 87, respectively. These knobs may be turned by hand to set the correct time when the clock is started.

FIG. 13 shows an alternative 4×5 dot matrix character display which uses a series of holes to distribute light over the length of each segment in the character or characters. The advantages of using only three rotatable disks and one stationary panel and having power transferred from one disk to another, which characterized the previously described clock design, can also be obtained in a clock using the dot matrix characters.

In FIG. 13 a fragment of a character display panel 90 is shown. It has a 4×5 matrix of holes 91 which may be open or occupied by transparent or translucent color material for transmitting light. Two holes in this matrix are shown shaded to indicate that they are not transmitting light at the present time while the remaining holes are transmitting so they define the illuminated character 2 (two). Another set of holes 92 are in a straight line and are for creating the numeral 1 (one). The two adjacent straight line and 4×5 dot matrixes permit display of the numerals 1 to 12 which are required for the hours display in a clock.

An hours generating rotatable opaque disk H is located behind panel 90 and its rear face is presented toward a light source as in the FIG. 1 embodiment. Disk H is actually provided with many holes 95 (some of which are omitted to avoid confusion) which transmit light toward the disk. These holes are arranged so that groups of them will selectively align with the panel holes as the H disk is rotated in steps to thereby define the number of sequence of 1 to 12.

Disk H has 12 circularly arranged pins 93 extending rearwardly from its rear face. The pins receive force for rotating disk H from the lug 94 on the adjacent disk T which is used for generating the tens of minutes character. Thus, it will be evident that driving forces can be exchanged from disk to disk and back to the arm 55 on the clock motor as in the FIGS. 1–12 embodiment and that no more than three disks which simply rotate unidirectionally will be required to display the hours, tens of minutes and minutes. The light diffusion panel, which would ordinarily be juxtaposed to the dot matrix character containing panel 90 has been omitted from FIG. 13.

Although the simplified digital display has been described in the environment of a digital clock, it should be appreciated that the principles of the design can be applied to other digital indicators as well. Accordingly, the scope of the invention is to be determined only by interpretation of the claims which follow.

I claim:

1. A segmented character display comprising:

means for defining elongated segments arranged to define characters when selectively illuminated, light pipe means coupled to said means for defining segments, respectively, and having input means for a beam of light and output means for providing light for distribution over the lengths of said means for defining segments, said segment defining means respectively including generally concave light reflective surfaces, said light pipe means being solid light conductive rods and said light output means being light directing surfaces at the ends of said rods within the concavities defined by said reflective surfaces, said surfaces on said rods being for directing light to said concave light reflective surfaces for distribution thereby, and a generally opaque rotatable disk having one side for being presented toward a source of light and an opposed side for being presented toward said means for defining segments, said disk having groups of light transmissive openings, rotation of said disk enabling openings in one group at a time to register with and transmit light to light pipe means to thereby illuminate said segments and produce a succession of characters.

2. A segmented character display comprising:

means for defining elongated segments arranged to define characters when selectively illuminated, light pipe means coupled to said means for defining segments, respectively, and having input means for a beam of light and output means for providing light for distribution over the lengths of said means for defining segments, said segments being defined by reflective curved surfaces forming a concavity presented toward the front of said display, said light pipe means being solid light conductive rods and said light output means being constituted by oppositely angulated substantially totally reflective surfaces formed in the ends of said rods for directing light from said rods to said reflective curved surfaces for distribution, and a generally opaque rotatable disk having one side for being presented toward a source of light and an opposed side for being presented toward said means for defining segments, said disk having groups of light transmissive openings, rotation of said disk enabling openings in one group at a time to register with and transmit light to light pipe means to thereby illuminate said segments and produce a succession of characters.

3. The display as in claim 2 wherein said reflective curved surfaces are substantially parabolic and said reflective surfaces on said light conductive rods are substantially at the focus of the parabola.

4. A digital clock comprising:

generally opaque panel means including a planar portion having digital displays comprised, repectively, of seven elongated segments arranged to form digits representing minutes, tens of minutes and hours observable from the front of said panel means, said segments being constituted by channels each comprised of spaced apart side walls and a bottom wall such as to provide an opening defining the shape of the segment, said walls and bottom being integral with said planar portion, light pipes extending into said channels, respectively, a plurality of generally opaque disks including a minute disk, a tens of minutes disk and an hour disk mounted for rotation in parallel planes rearwardly of said panel means, said disks having a rear side for being presented toward a source of light and an opposed side for being presented toward said panel means, each of said disks having groups of light transmissive openings, rotation of said disks in successive angular steps enabling one group of openings at a time in each disk to register with and transmit light to said light pipe means to thereby illuminate said segments and produce a succession of digits, a synchronous motor having a shaft rotatable at one revolution per minute and a drive arm fixed to and extending radially from said shaft, said minutes disk having ten pin means equiangularly arranged around its rotational axis in the path of said drive arm, said pin means being engaged by said arm for rotating said minutes disk one angular step for each revolution of the arm, said minutes disk having lug means extending from it, said tens of minutes disk being adjacent said minutes disk and having six pin means arranged around its rotational axis in the path of said lug means on the minutes disk, said pin means on the tens of minutes disk being engaged by said lug means on the minutes disk for being rotated through one angular step every ten minutes, said tens of minutes disk having lug means extending from it, said hours disk being adjacent said tens of minutes disk and having twelve pin means equiangularly arranged around its rotational axis in the path of said lug means on the hours disk being engaged by said lug means on the tens of minutes disk for being rotated through one angular step every hour.

5. The clock as in claim 4 wherein at least said bottom walls of said channels are coated with a material for reflecting light diffusely.

6. The clock as in claim 4 wherein said bottom walls of said channels are curved and said light pipes, respectively, are shaped for projecting light on said bottom walls to obtain light distribution over the lengths of said segments.

7. The clock as in claim 4 wherein said bottom walls are curved as a parabola, said light pipes are solid plastic rods notched at their ends within the channels to provide prism reflecting surfaces for projecting light onto said bottom walls of said channels.

8. The clock as in claim 4 including a housing for said disks, said housing having a rear wall composed of plastic material in which a plurality of condensing lenses are integrally formed for directing light into said light pipes, respectively, said lenses being arranged in correspondence with said light pipes.

9. The clock as in claim 4 including a light diffuser plate disposed in front of said panel to diffuse the light of said segments.

10. The clock as in claim 4 transparent light transmissive elements disposed in said channels and having lengths corresponding with the lengths of the segments and having a plurality of prism surfaces, and said light pipes, respectively, being integral with said elements and generally perpendicular to them.

* * * * *